United States Patent [19]

Shimai

[11] 4,252,303

[45] Feb. 24, 1981

[54] SELF-ALIGNABLE HOLDER FOR A ROW OF SLIDE FASTENER COUPLING ELEMENTS

[75] Inventor: Hideo Shimai, Namerikawa, Japan

[73] Assignee: Yoshida Kogyo K.K., Tokyo, Japan

[21] Appl. No.: 98,186

[22] Filed: Nov. 28, 1979

[30] Foreign Application Priority Data

Dec. 22, 1978 [JP] Japan ..... 53-157670

[51] Int. Cl.[3] ..... B23P 19/04

[52] U.S. Cl. ..... 269/43; 29/766; 269/152; 269/237; 269/254 CS; 269/256; 269/318; 269/319

[58] Field of Search ..... 29/408–410, 29/766–770; 269/321 W, 37, 43, 152, 153, 237–239, 254 R, 254 CS, 256, 318, 319

[56] References Cited

U.S. PATENT DOCUMENTS

| | | | |
|---|---|---|---|
| 416,737 | 12/1889 | Nathan | 269/318 |
| 1,110,683 | 9/1914 | Goodwin | 269/256 X |
| 3,815,208 | 6/1974 | Kawakami | 269/321 W X |
| 3,844,014 | 10/1974 | Takahushi et al. | 269/321 W X |
| 3,945,103 | 3/1976 | Fujisaki et al. | 29/768 |
| 3,991,991 | 11/1976 | Hammer | 269/318 |

*Primary Examiner*—Robert C. Watson

[57] ABSTRACT

A self-alignable holder holds a row of coupling elements mounted on a slide fastener stringer tape in alignment with a slot cutter regardless of the size of the coupling elements. The holder includes a base having a slot receptive of the stringer tape, a pair of parallel holding plates movably disposed on the base for laterally sandwiching the row of coupling elements therebetween, a pair of parallel-motion links pivotally connecting the holding plates together, and a pair of supports mounted on the base and pivotally supporting the links so that the gripping edges of the holding plates are equidistant from the longitudinal axis of the slot. Spring means in the base urge the holding plates laterally toward each other for holding the row of coupling elements in longitudinal alignment with the slot axis resiliently with equalized lateral forces.

12 Claims, 10 Drawing Figures

SELF-ALIGNABLE HOLDER FOR A ROW OF SLIDE FASTENER COUPLING ELEMENTS

BACKGROUND OF THE INVENTION

Field of the Invention

The present invention relates to a holder for a row of slide fastener coupling elements, and more particularly to a self-alignable holder for holding a row of slide fastener coupling elements in alignment with a slot cutter.

SUMMARY OF THE INVENTION

A holder for a row of slide fastener coupling elements on a stringer tape comprises a base having a slot receptive of the stringer tape, a pair of parallel holding plates movably disposed on the base for laterally sandwiching the row of coupling elements therebetween, a pair of parallel-motion links pivotally connecting the holding plates together, and a pair of supports mounted on the base and pivotally supporting the links so that the opposed edges of the holding plates are equidistant from the longitudinal axis of the slot. Spring means in the base urge the holding plates laterally toward each other for holding the row of coupling elements with equalized lateral forces in alignment with a slot cutter regardless of the size of the coupling elements.

An object of the present invention is to provide a holder for holding a row of slide fastener coupling elements in alignment with a line of reference regardless of the size of the coupling elements.

The above and other objects, features and advantages of the present invention will become apparent from the following description when taken in conjunction with the accompanying drawings.

DETAILED DESCRIPTION

Figure 1:
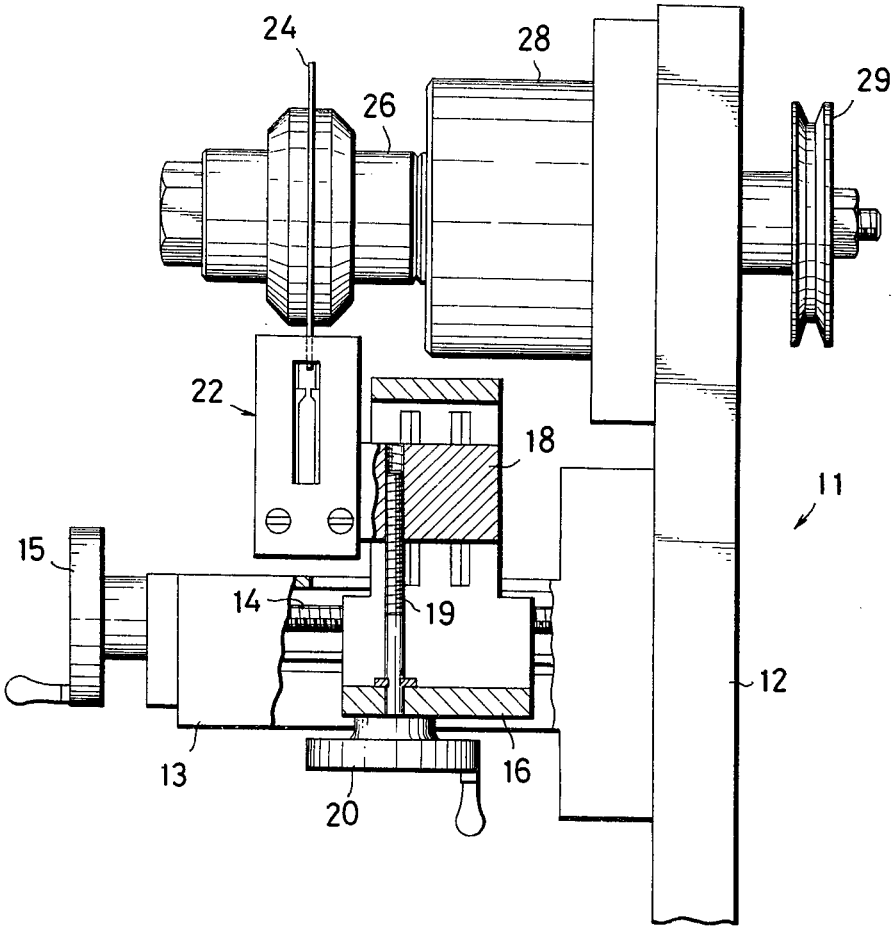
FIG. 1 is a side elevational view of a slot cutting machine incorporating a pair of self-alignable holders embodying the present invention.
Figure 2:
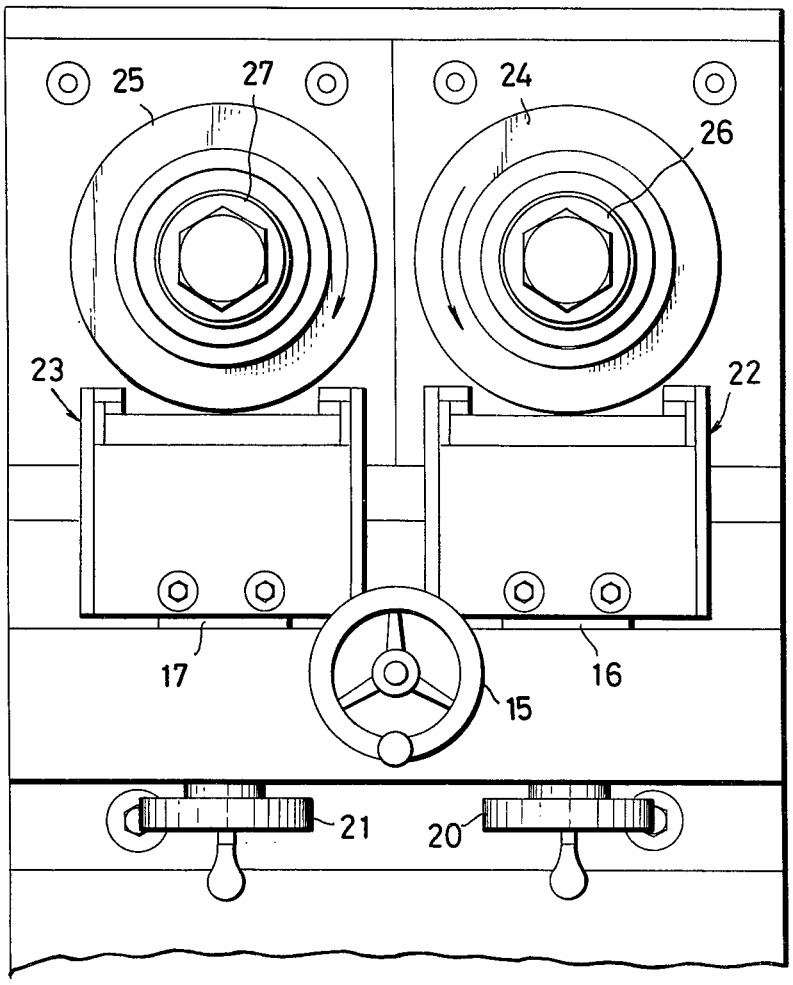
FIG. 2 is a front elevational view of the slot cutting machine shown in FIG. 1.

A slot cutting machine 11 shown in FIGS. 1 and 2, for slotting a row of slide fastener coupling elements at their coupling heads comprises a vertical frame 12 supporting a horizontal table 13 in which a feed screw 14 is rotatably disposed, the feed screw 14 having one end to which a horizontal adjustment handwheel 15 is attached. A pair of carriers 16,17 are threadedly guided on the feed screw 14 for horizontal adjusting movement. A pair of supports 18 (one shown in FIG. 1) are vertically movable respectively on a pair of feed screws 19 (one shown in FIG. 1) rotatably disposed in the respective carriers 16,17 and rotatable by a pair of vertical adjustment handwheels 20,21, respectively.

A pair of self-alignable holders 22,23 are attached to the supports 18, respectively, and are located below a pair of corresponding disk-shaped slot cutters 24,25 mounted respectively on a pair of spindles 26,27 rotatably supported by a pair of respective spindle heads 28 (one shown in FIG. 1). The spindles 26,27 are rotatively driven by a pair of belt-driven pulleys 29 (one shown in FIG. 1), respectively.

By rotating the handwheel 15 and the handwheels 20,21, the self-alignable holders 22,23 are positionally adjusted in the horizontal and vertical directions so as to be located just below the slot cutters 24,25, respectively, in vertical alignment therewith.

As illustrated in FIGS. 3–7, each of the self-alignable holders 22,23 comprises an elongate base 31 having an upper surface 32 and a longitudinal vertical slot 33 opening at the upper surface 32. A pair of elongate holding plates 34,35 are movably disposed on the upper surface 32 of the base 31, one on each side of the slot 33, the holding plates 34,35 having a pair of respective longitudinal opposed edges 36,37 for jointly laterally sandwiching therebetween a row of slide fastener coupling elements 38 of molded synthetic resin or metal mounted on a stringer tape 39, which is received in the slot 33 in the base 31.

A pair of support plates 40,41 are mounted on the base 31 at its ends and include a pair of respective bracket arms 42,43 projecting over the upper surface 32 of the base 31 in alignment with the slot 33. The bracket arms 42,43 pivotally support a pair of parallel-motion links 44,45, respectively, at their central portions by means of a pair of corresponding pins 46,47.

The holding plates 34,35 are pivotally connected together at their end portions by the links 44,45 through two respective pairs of pins 48,49. The holding plates 34,35 are longitudinally and laterally movable on the upper surface 32 of the base 31 with their longitudinal confronting edges 36,37 being equidistant from the longitudinal axis of the slot 33 at all times irrespective of varying positions of the holding plates 34,35.

Each of the support plates 40,41 has a vertically elongate hole 50 (FIG. 5) for passage therethrough of the stringer tape 39 with the row of coupling elements 38 thereon into the slot 33 in the base 31.

Figure 3:
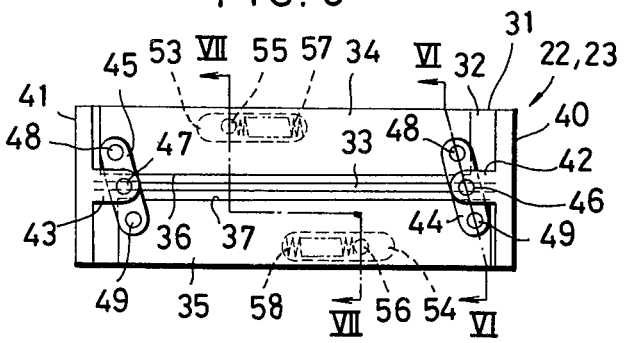
FIG. 3 is a plan view of one of the self-alignable holders shown in FIG. 1.
Figure 4:
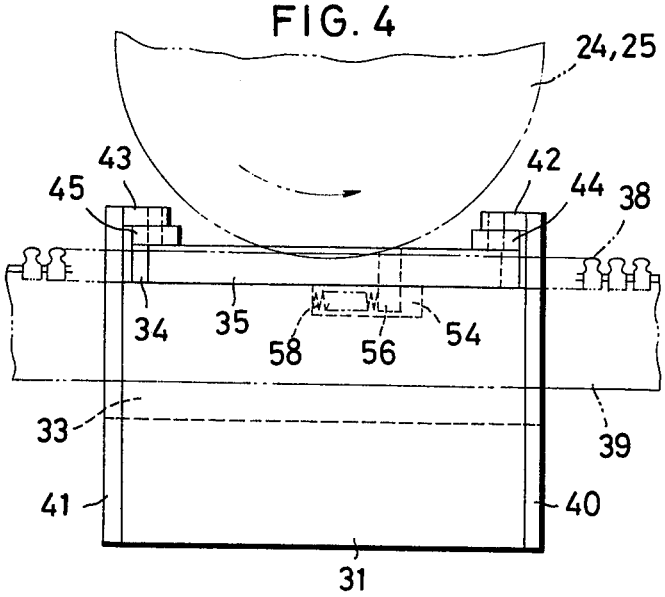
FIG. 4 is a front elevational view of the self-alignable holder.
Figure 5:
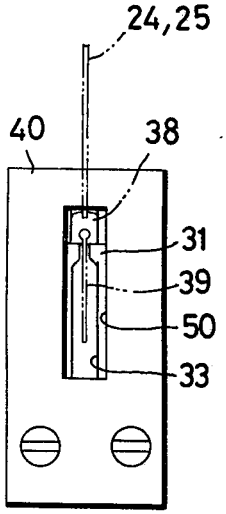
FIG. 5 is a side elevational view of the self-alignable holder.
Figure 6:
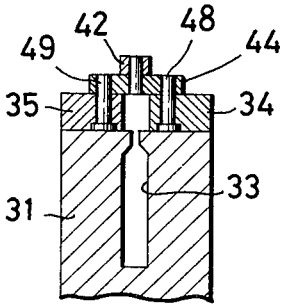
FIG. 6 is a fragmentary cross-sectional view taken along line VI—VI of FIG. 3.
Figure 7:
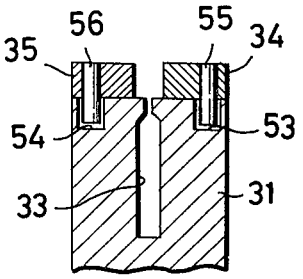
FIG. 7 is a fragmentary cross-sectional view taken along line VII—VII of FIG. 3.

The base 31 has a pair of laterally displaced grooves 53,54 one on each side of the slot 33, which grooves 53,54 open at the upper surface 32 toward the holding plates 34,35, respectively, and extend in the longitudinal direction of the base 31. A pair of vertical pins 55,56 project downwardly from the holding plates 34,35, respectively, into the corresponding grooves 53,54. A pair of compression coil springs 57,58 are disposed respectively in the grooves 53,54, the spring 57 acting between the pin 55 and an end wall of the groove 53 and the spring 58 acting between the pin 56 and an end wall of the groove 54. The springs 57,58 normally bias the holding plates 34,35 respectively, leftwardly and rightwardly, respectively, as illustrated in FIG. 3 and at the same time toward each other due to the centrally pivoted links 44,45.

Figure 10:
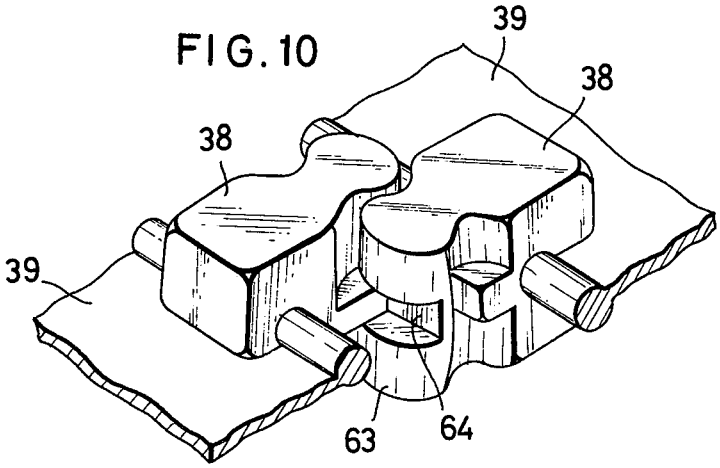
FIG. 10 is an enlarged perspective view of a pair of slotted coupling elements interengaged together.

In operation of the slot cutting machine 11, the stringer tape 39 is first inserted through the slot 33 with the row of coupling elements 38 sandwiched between the holding plates 34,35. The self-alignable holders 22,23 are then adjustably moved into respective positions beneath the slot cutters 24,25 by adjustive rotation of the handwheel 15, in which positions the longitudinal axes of the slots 33 in the holder base 31 are held in vertical alignment with the slot cutters 24,25, respectively. The slot cutters 24,25 are driven, and the handwheels 20,21 are turned to raise the holders 22,23, respectively, by a predetermined amount to cause the slot cutters 24,25 to slot at 64 (FIG. 10) the coupling heads 63 of the coupling elements 38 as the latter are longitudinally fed along through the holders 22,23.

Figure 8:
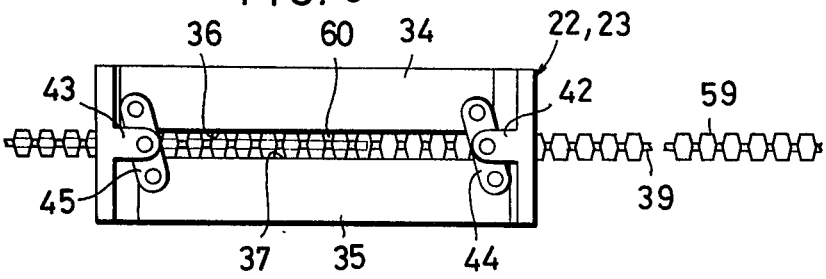
FIGS. 8 and 9 are plan views of the self-alignable holder as it holds rows of coupling elements having different thicknesses or widths, respectively.
Figure 9:
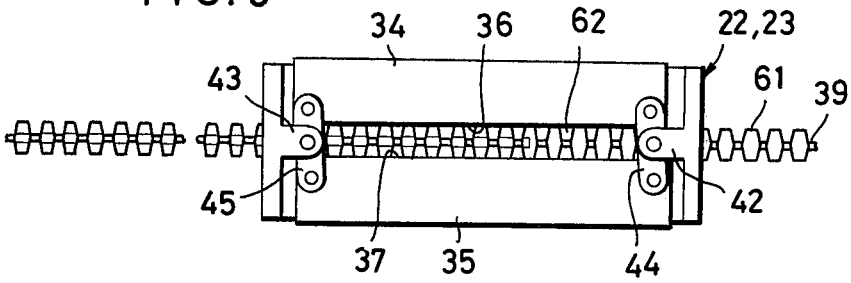

With the self-alignable holders 22,23 thus constructed, a variety of rows of molded coupling elements 59,61 (FIGS. 8 and 9) having different thicknesses or widths due to their dimensional errors or their being made on different molding machines, can be axially aligned with the slot cutters 24,25, serving as a line of reference, by the holding plates 34,35 that jointly sandwich therebetween one of the rows of coupling elements 59,61 at a time resiliently with equalized lateral forces, leaving elongate varying gaps 60,62, respectively, between the opposed edges 36,37 of the holding plates 34,35 for the introduction therein of the slot cutters 24,25. Accordingly, the rows of coupling elements 59,61 can be slotted centrally along their longitudinal axes regardless of their differences in thickness or width.

Although a certain preferred embodiment has be shown and described in detail, it should be understood that changes and modifications may be made therein without departing from the scope of the present invention, which is defined in the appended claims.

I claim as my invention:

1. A holder for a row of slide fastener coupling elements mounted on a stringer tape, comprising:

(a) a base having a slot receptive of the stringer tape;

(b) a pair of parallel holding plates disposed one on each side of said slot for laterally sandwiching the row of coupling elements therebetween;

(c) a pair of parallel-motion links pivotally connecting said holding plates together;

(d) a pair of supports mounted on said base and pivotally supporting said links, respectively; and (e) spring means in said base, urging said holding plates laterally toward each other, whereby said holding plates can hold the row of coupling elements with equalized lateral forces.

2. A holder according to claim 1, said base having a surface at which said slot opens, said holding plates being disposed on said surface.

3. A holder according to claim 2, said holding plates having a pair of opposed edges, respectively, equidistant from the longitudinal axis of said slot for jointly sandwiching the row of coupling elements in alignment with said longitudinal axis of said slot.

4. A holder according to claim 1, said parallel-motion links being disposed respectively at end portions of said holding plates, leaving an elongate, variable gap between said holding plates.

5. A holder according to claim 4, said pair of supports including a pair of bracket arms, respectively, disposed at end portions of said base in alignment with said slot, said links being pivotally supported substantially centrally by said bracket arms.

6. A holder according to claim 1, said spring means comprising a pair of springs each acting between said base and one of said holding plates.

7. A holder according to claim 6, said base having a pair of grooves opening toward said holding plates, said springs being disposed in said grooves, respectively.

8. A holder for holding a row of slide fastener coupling elements mounted on a stringer tape, in longitudinal alignment with a slot cutter, comprising:

(a) an elongate base having a surface and a slot receptive of the stringer tape, said slot having a longitudinal axis alignable with the slot cutter;

(b) a pair of parallel holding plates disposed on said surface and having a pair of respective opposed edges for jointly laterally sandwiching the row of coupling elements therebetween;

(c) a pair of parallel-motion links pivotally connecting said holding plates to each other for lateral gripping motion of said holding plates;

(d) a pair of supports mounted on said base and pivotally supporting said links with said opposed edges of said holding plates being equidistant at all times from said longitudinal axis; and (e) spring means in said base, urging said holding plates toward each other, whereby said holding plates can hold the row of coupling elements in alignment with said longitudinal axis with equalized lateral forces.

9. A holder according to claim 8, said parallel-motion links being disposed respectively at end portions of said holding plates, leaving an elongate, variable gap between said opposed edges of said holding plates for the introduction therein of the slot cutter.

10. A holder according to claim 9, said pair of supports including a pair of bracket arms, respectively, disposed at end portions of said base in alignment with said slot, said links being pivotally supported substantially centrally by said bracket arms.

11. A holder according to claim 8, said spring means comprising a pair of springs each acting between said base and one of said holding plates.

12. A holder according to claim 11, said base having a pair of grooves opening toward said holding plates, said springs being disposed in said grooves, respectively.

* * * * *